US011091983B2

(12) United States Patent
Costa De Oliveira et al.

(10) Patent No.: US 11,091,983 B2
(45) Date of Patent: Aug. 17, 2021

(54) SMART CIRCULATION SUB

(71) Applicant: Saudi Arabian Oil Company, Dhahran (SA)

(72) Inventors: Victor Carlos Costa De Oliveira, Dhahran (SA); Mario Augusto Rivas Martinez, Dhahran (SA); Helmut Josip Luquetta Berrio, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/716,356

(22) Filed: Dec. 16, 2019

(65) Prior Publication Data

US 2021/0180430 A1 Jun. 17, 2021

(51) Int. Cl.
*E21B 34/14* (2006.01)
*E21B 34/10* (2006.01)
*E21B 21/08* (2006.01)

(52) U.S. Cl.
CPC ..... *E21B 34/102* (2013.01); *E21B 21/08* (2013.01); *E21B 2200/04* (2020.05)

(58) Field of Classification Search
CPC ..... E21B 21/08; E21B 21/10; E21B 2200/04; E21B 34/06; E21B 34/10; E21B 34/14
See application file for complete search history.

(56) References Cited

U.S. PATENT DOCUMENTS 5,465,787 A 11/1995 Roth
5,890,540 A 4/1999 Pia et al.
6,173,795 B1 1/2001 McGarian et al.
7,201,230 B2 * 4/2007 Schultz ..... E21B 47/16 166/373
7,252,152 B2 * 8/2007 LoGiudice ..... E21B 41/00 166/386

(Continued)

FOREIGN PATENT DOCUMENTS

GB 2454994 A 5/2009
WO 2013155257 A2 10/2013
WO 2019075290 A1 4/2019

OTHER PUBLICATIONS

International Search Report and Written Opinion of PCT Application No. PCT/US2020/065250 (SA51163) dated Mar. 12, 2021: pp. 1-12.

*Primary Examiner* — Cathleen R Hutchins
*Assistant Examiner* — Ronald R Runyan
(74) *Attorney, Agent, or Firm* — Bracewell LLP; Constance G. Rhebergen; Linda L. Morgan

(57) ABSTRACT

A circulation sub assembly for circulating fluids in a subterranean well includes a circulation sub body that is a generally tubular shaped member with a sub central bore. A circulation port extends through a sidewall of the circulation sub body. A valve member is moveable between a closed position where the valve member prevents a flow of fluid through the circulation port and an open position where the valve member provides a fluid flow path through the circulation port. An actuation assembly includes an isolated hydraulic fluid system operable to move the valve member between the closed position and the open position. A control system includes an electronic processor, a memory, a data transmitter, and a data receiver. The control system is operable to instruct the actuation assembly to move the valve member between the closed position and the open position.

20 Claims, 3 Drawing Sheets

(56) References Cited

U.S. PATENT DOCUMENTS

| | | | | |
|---|---|---|---|---|
| 8,776,896 | B2 | 7/2014 | Konschuh et al. | |
| 9,133,682 | B2 | 9/2015 | Tahoun et al. | |
| 9,371,708 | B2 | 6/2016 | Weir et al. | |
| 9,382,769 | B2 | 7/2016 | Wilson et al. | |
| 9,404,359 | B2 | 8/2016 | Fraser | |
| 9,587,486 | B2 * | 3/2017 | Walton | E21B 34/066 |
| 10,030,474 | B2 | 7/2018 | Themig et al. | |
| 2015/0047834 | A1 * | 2/2015 | Nott | E21B 21/106 166/250.01 |
| 2016/0222743 | A1 | 8/2016 | Gosney | |
| 2016/0312579 | A1 | 10/2016 | Green et al. | |
| 2017/0241238 | A1 | 8/2017 | Bacsik et al. | |
| 2018/0202247 | A1 | 7/2018 | Johnson et al. | |
| 2018/0328141 | A1 | 11/2018 | Solem | |

* cited by examiner

SMART CIRCULATION SUB

BACKGROUND OF THE DISCLOSURE

1. Field of the Disclosure

The present disclosure relates to subterranean well development, and more specifically, the disclosure relates to fluid circulation within the subterranean well during well development operations.

2. Description of the Related Art

Circulation subs can be used within subterranean wells to divert a flow of fluids from within the drill string into the annulus that is defined outside of the drill string within the wellbore. Currently available hydraulically operated circulation subs can allow for pumping material and fluid into the wellbore in circumstances where the flow rate is restricted and such pumping would otherwise be unachievable without the circulation sub.

For currently available hydraulically operated circulation subs the tool can activated by a ball that is either free-falling or pumped down into the bore of the drill string until the ball is set into a seat or ball catcher receptacle inside the circulation sub. An increased fluid pressure is then applied from the surface to hydraulically open side ports of the circulation sub. The open ports allow the circulation sub to divert the mud flow or the flow of other fluids out of the drill string above the bottom hole assembly, establishing a new circulation point away from the drill bit.

The use of a circulation sub can provide for not only higher rates of flow of fluid through the drill string, but also larger concentrations of remedial materials, which could otherwise be restricted by flow limitations of measurement while drilling, logging while drilling, positive displacement motors, or other downhole tools. Circulation subs can be used, as an example, for hole cleaning, removal of cuttings or other debris, fluids displacement by zone, spotting remediation fluids, a jetting device, or surge pressure reduction.

In order to close the ports of the circulation sub another ball can be dropped to close the sliding sleeve over the side ports so that fluids flowing through the drill string are circulating through the drill bit. In other currently available systems, an auto-lock assembly can close the ports if the flow reaches certain level or the mud pumps are shut down completely.

SUMMARY OF THE DISCLOSURE

Currently available circulation subs can have ports that are mechanically moved between the closed position and the open position and can provide no positive indication of the performance of the ports of the circulation sub. Therefore there can be uncertainty relating to the position of the ports. Further, when using a dropped ball to move the ports between the closed and open position, an amount of fluid will pass out of the ports and through the drill bit during the time it takes for the ball to reach the circulation sub. The time it takes for the ball to reach the circulation sub and the loss of fluid can be particular problem if the need to use the circulation sub is due to an unexpected event such as excessive pressure within the wellbore. In addition, the added pressure required to move the ports to the open position after the ball is seated can itself be close to the bursting pressure of the drilling string. Further still, in some current circulation subs only a limited number of balls can be seated, limiting the number of times that the ports can be moved between the closed and open positions.

Embodiments of the current application provide systems and method for real time monitoring of the circulation sub and the conditions within the wellbore in the vicinity of the circulation sub in real time. Information gathered within the wellbore of the subterranean well can be delivered to the earth's surface by way of radio waves. Systems and method of this disclosure eliminate the use of balls or the need for differential pressure within the bore of the drill string for actuation.

Embodiments of this disclosure further provide for an independent activation system that is self-contained within the wall of the circulation sub. The valve associated with the ports of the current systems and methods can be moved between the closed and open position an unlimited number of times. The control system of the current disclosure can be used with multiple tools within the drill string which can be operated independently.

In an embodiment of this disclosure, a circulation sub assembly for circulating fluids in a subterranean well includes a circulation sub body, the circulation sub body being a generally tubular shaped member with a sub central bore. A circulation port extends through a sidewall of the circulation sub body. A valve member is moveable between a closed position where the valve member prevents a flow of fluid through the circulation port and an open position where the valve member provides a fluid flow path through the circulation port. An actuation assembly includes an isolated hydraulic fluid system operable to move the valve member between the closed position and the open position. A control system includes an electronic processor, a memory, a data transmitter, and a data receiver. The control system is operable to instruct the actuation assembly to move the valve member between the closed position and the open position.

In alternate embodiments, a biasing member can urge the valve member towards the closed position. A battery can be in wired communication with the control system and the actuation assembly. The control system can be in wired communication with the actuation assembly. The control system can be in wired communication with the valve member. The data transmitter and the data receiver of the control system can be in communication with a local area network located at an earth's surface by way of radio waves. The valve member, the actuation assembly, and the control system can be located within the sidewall of the circulation sub body. The sub central bore can have a constant inner diameter from an uphole end of the circulation sub body to a downhole end of the circulation sub body.

In an alternate embodiment of this disclosure, a circulation sub assembly for circulating fluids in a subterranean well includes a downhole drill string located within a wellbore of the subterranean well and having a downhole central bore. An uphole drill string is located within the wellbore of the subterranean well and having an uphole central bore. A circulation sub body is secured between the downhole drill string and the uphole drill string, the circulation sub body being a generally tubular shaped member with a sub central bore that is in fluid communication with the downhole central bore and the uphole central bore. The sub central bore has a constant inner diameter from an uphole end of the circulation sub body to a downhole end of the circulation sub body. An inner diameter of the sub central bore is substantially equal to an inner diameter of the downhole central bore and an inner diameter of the uphole central bore. A circulation port extends through a sidewall of the circulation sub body. A valve member is moveable between a closed position where the valve member prevents a flow of fluid through the circulation port, and an open position where the valve member provides a fluid flow path through the circulation port from the sub central bore to an annulus defined between an outer diameter surface of the circulation sub body and an inner diameter surface of the wellbore. An actuation assembly includes an isolated hydraulic fluid system operable to move the valve member between the closed position and the open position. A control system is operable to instruct the actuation assembly to move the valve member between the closed position and the open position, where the control system is in communication with a local area network located at an earth's surface by way of radio waves and is in wired communication with the actuation assembly.

In alternate embodiments, a biasing member can urge the valve member towards the closed position. A battery can be in wired communication with the control system and the actuation assembly. The control system can include an electronic processor, a memory, a data transmitter, and a data receiver. The valve member, the actuation assembly, and the control system can be located within the sidewall of the circulation sub body.

In another alternate embodiment of this disclosure, a method for circulating fluids within a subterranean well with a circulation sub includes securing a circulation sub body between a downhole drill string having a downhole central bore and an uphole drill string having an uphole central bore. The circulation sub body is a generally tubular shaped member with a sub central bore that is in fluid communication with the downhole central bore and the uphole central bore. The sub central bore has a constant inner diameter from an uphole end of the circulation sub body to a downhole end of the circulation sub body. An inner diameter of the sub central bore is substantially equal to an inner diameter of the downhole central bore and an inner diameter of the uphole central bore. A circulation port extends through a sidewall of the circulation sub body. The downhole drill string, the circulation sub body, and the uphole drill string are located within a wellbore of the subterranean well. A control system is used to instruct an actuation assembly to move a valve member between a closed position and an open position. In the closed position the valve member prevents a flow of fluid through the circulation port, and in the open position the valve member provides a fluid flow path through the circulation port from the sub central bore to an annulus defined between an outer diameter surface of the circulation sub body and an inner diameter surface of the wellbore. The actuation assembly includes an isolated hydraulic fluid system operable to move the valve member between the closed position and the open position. The control system is in communication with a local area network located at an earth's surface by way of radio waves and is in wired communication with the actuation assembly.

In alternate embodiments, the valve member can be urged towards the closed position with a biasing member. The method can further include providing power to the control system and the actuation assembly with a battery that is in wired communication with the control system and the actuation assembly. The control system can include an electronic processor, a memory, a data transmitter, and a data receiver. The valve member, the actuation assembly, and the control system can be located within the sidewall of the circulation sub body. A real time status of the valve member can be delivered to the earth's surface with the control system. An operating command can be delivered wirelessly in real time from the earth's surface to the control system.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

As used in this Specification, the term "substantially equal" means that the values being referenced have a difference of no more than two percent of the larger of the values being referenced.

Where reference is made in the specification and appended Claims to a method comprising two or more defined steps, the defined steps can be carried out in any order or simultaneously except where the context excludes that possibility.

Figure 1:
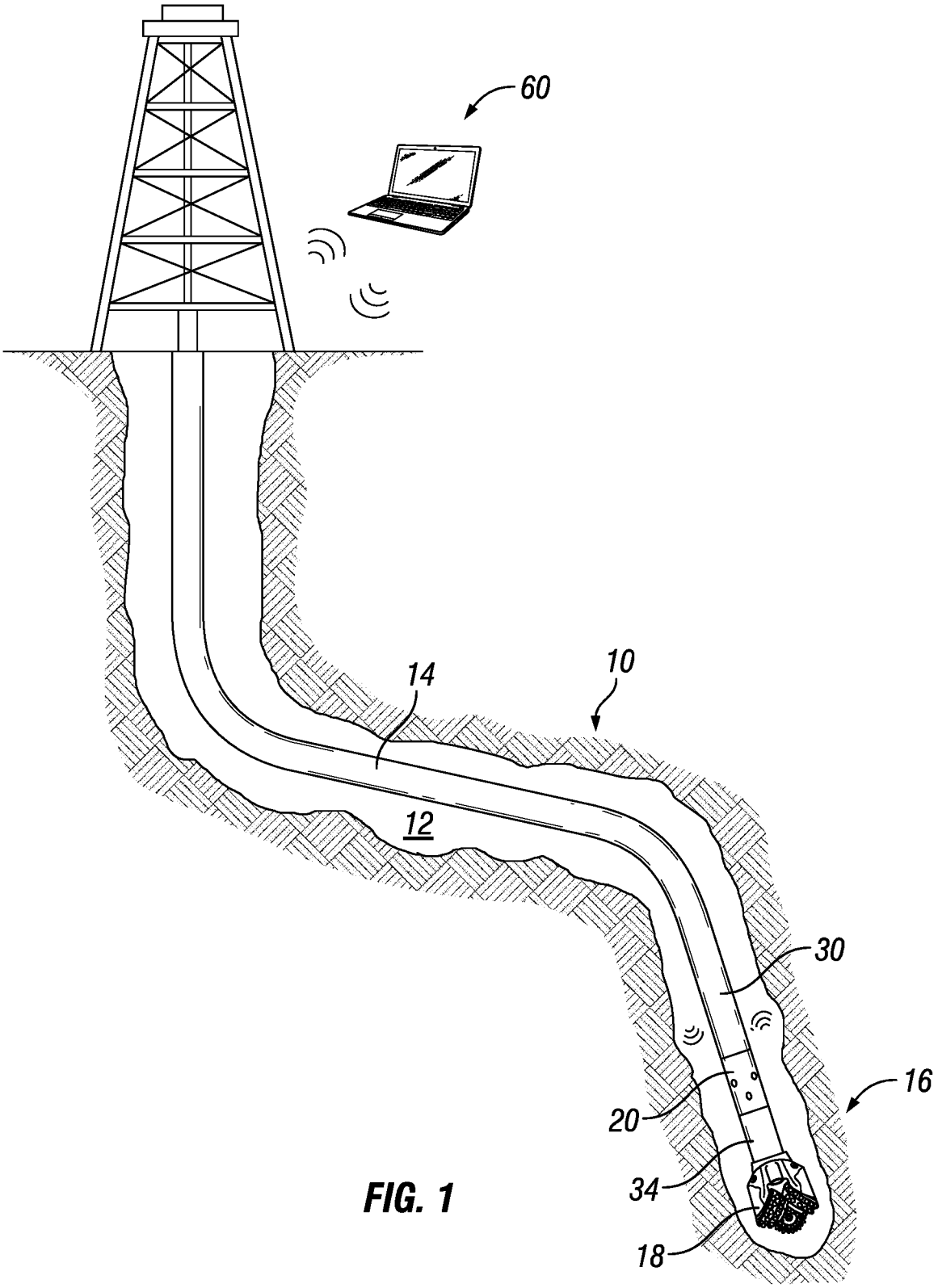
FIG. 1 is a partial section view of a subterranean well with a smart circulation sub, in accordance with an embodiment of this disclosure.

Looking at FIG. 1, subterranean well 10 extends downwards from a surface of the earth, which can be a ground level surface or a subsea surface. Wellbore 12 of subterranean well 10 can extended generally vertically relative to the surface. Wellbore 12 can alternately include portions that extend generally horizontally or in other directions that deviate from generally vertically from the surface. Subterranean well 10 can be a well associated with hydrocarbon development operations, such as a hydrocarbon production well, an injection well, or a water well.

Tubular string 14 extends into wellbore 12 of subterranean well 10. Tubular string 14 can be, for example, a drill string, a casing string, or another elongated member lowered into subterranean well 10. Although wellbore 12 is shown as an uncased opening, in embodiments where tubular string 14 is an inner tubular member, wellbore 12 can be part of an outer tubular member, such as casing.

Tubular string 14 can include downhole tools and equipment that are secured in line with joints of tubular string 14. Tubular string 14 can have, for example, a bottom hole assembly 16 that can include a drill bit 18. Drill bit 18 can rotate to create wellbore 12 of subterranean well 10.

Circulation sub 20 can also be secured in line with tubular string 14 for circulating fluids in subterranean well 10. More than one circulation sub 20 can be used within a single tubular string 14. Multiple circulation subs 20 can work independently or together, as needed to achieve the desired results improvement to subterranean operations in wellbore 12.

Figure 2:
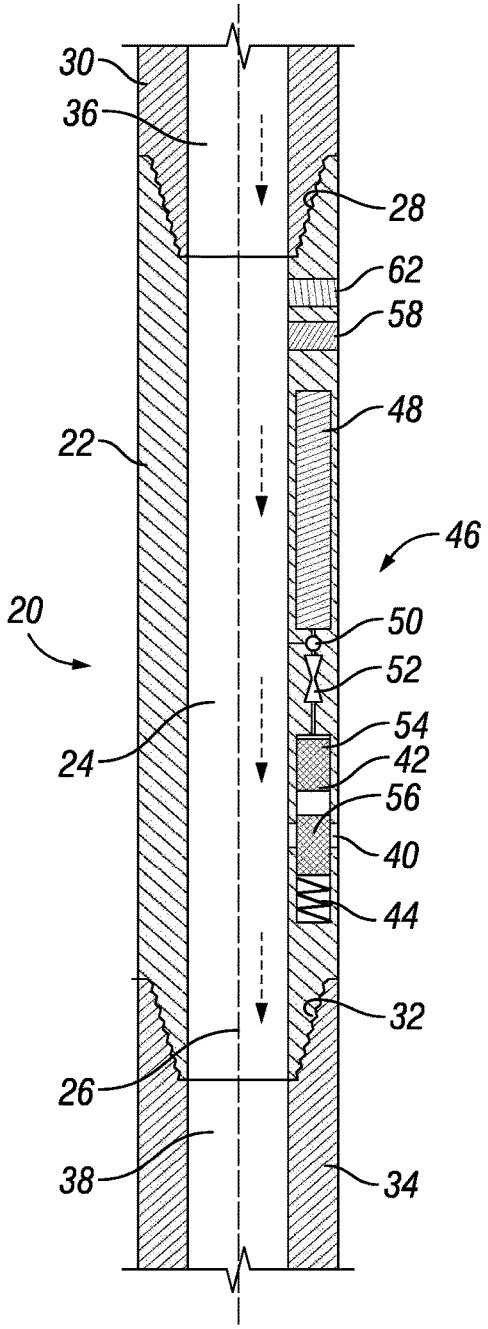
FIG. 2 is a schematic section view of a smart circulation sub, in accordance with an embodiment of this disclosure, shown with circulation ports in a closed position.
Figure 3:
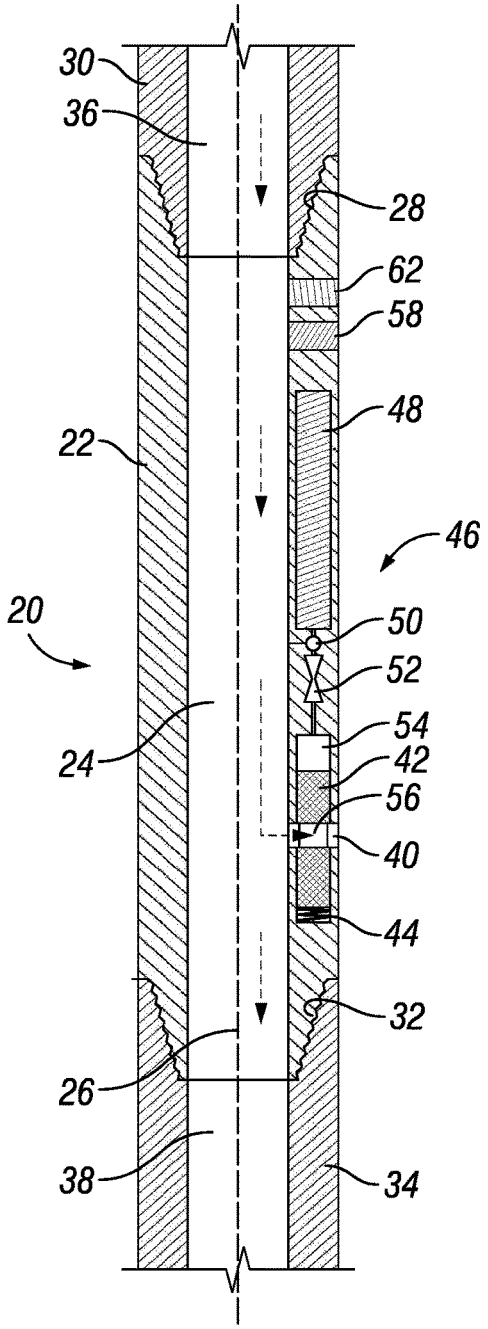
FIG. 3 is a schematic section view of a smart circulation sub, in accordance with an embodiment of this disclosure, shown with circulation ports in an open position.

Looking at FIGS. 2-3, circulation sub 20 can have circulation sub body 22. Circulation sub body 22 can be an elongated generally tubular shaped member. Circulation sub body 22 can include sub central bore 24. Sub central bore 24 can be centered around longitudinal axis 26 of circulation sub body 22.

Circulation sub body 22 can include uphole connector 28 that can be used to secure an uphole end of circulation sub body 22 to uphole drill string 30. In the example embodiment of FIGS. 2-3 uphole connector 28 is a threaded connector of a type that is common in the industry for securing together joints of drill pipe. In alternate embodiments uphole connector 28 can be another known type of connector used to secure together joints of drill pipe.

Circulation sub body 22 can further include downhole connector 32 that can be used to secure a downhole end of circulation sub body 22 to downhole drill string 34. In the example embodiment of FIGS. 2-3 downhole connector 32 is a threaded connector of a type that is common in the industry for securing together joints of drill pipe. In alternate embodiments downhole connector 32 can be another known type of connector used to secure together joints of drill pipe.

Uphole drill string 30 can have uphole central bore 36. Downhole drill string 34 can have downhole central bore 38. Uphole drill string 30 and downhole drill string 34 can be secured to circulation sub body 22 so that sub central bore 24 is in fluid communication with downhole central bore 38 and uphole central bore 36.

Sub central bore 24 can have a constant inner diameter over the entire length of sub central bore 24 from the uphole end of circulation sub body 22 to the downhole end of circulation sub body 22. That is, there can be no reduction in the diameter of sub central bore 24 along the length of sub central bore.

In embodiments of the disclosure, the inner diameter of sub central bore 24 is substantially equal to an inner diameter of downhole central bore 38 and an inner diameter of uphole central bore 36. Having a constant inner diameter will allow for access for tools, equipment, and instruments through sub central bore 24 without increasing the concern that such tools, equipment or instruments would become stick within sub central bore 24. Further, it there was a reduction in the inner diameter of sub central bore 24 there could be a risk that the fluids or other materials traveling through sub central bore 24 would require a higher pressure to pass through the reduced diameter region.

Circulation port 40 extends through a sidewall of circulation sub body 22. In the example embodiment of FIGS. 2-3 only one circulation port 40 is shown. In alternate embodiments there can be more than one circulation port 40.

Circulation sub 20 can also include valve member 42. Valve member 42 is moveable between a closed position (FIG. 2) where valve member 42 prevents the flow of fluid through circulation port 40 and an open position (FIG. 3) where valve member 42 provides a fluid flow path through circulation port 40. When in the open position, valve member 42 provides a fluid flow path through circulation port 40 between sub central bore 24 to an annulus defined between the outer diameter surface of circulation sub body 22 and an inner diameter surface of wellbore 12.

In the example embodiment of FIGS. 2-3, valve member 42 is a plate or curved member that does not extend fully around a circumference of circulation sub body 22. In alternate embodiments valve member 42 could be a ring shaped member. Valve member 42 is located within a sidewall of circulation sub body 22. Valve member 42 does not physically interfere with operations within sub central bore 24 or within wellbore 12 outside of circulation sub 20.

When valve member 42 is in the closed position, all fluids delivered into sub central bore 24 pass from uphole central bore 36, through sub central bore 24, and into downhole central bore 38, as shown in FIG. 2. When valve member 42 is in the open position, a portion of the fluids delivered into sub central bore 24 pass from uphole central bore 36, through sub central bore 24, and into downhole central bore 38, and another portion of the fluids delivered into sub central bore 24 exit sub central bore 24 through valve member 42, as shown in FIG. 3.

Biasing member 44 can urge valve member 42 towards the closed position. In the example embodiments shown, biasing member 44 is a spring.

Circulation sub 20 can further include actuation assembly 46. Actuation assembly 46 can be used to move valve member 42 between the closed position and the open position. Actuation assembly 46 can include an isolated hydraulic fluid system that has hydraulic fluid tank 48, hydraulic pump 50, hydraulic relief valve 52, and expandable reservoir 54. Hydraulic fluid system is s closed system so that hydraulic fluid within the hydraulic fluid system does not mix with other fluids within subterranean well 10. In this way, the hydraulic fluid remains clean and free from contamination. The hydraulic fluid system is located within a sidewall of circulation sub body 22. Circulation sub body 22 can be machined to provide the space for the hydraulic fluid system. The hydraulic fluid system does not physically interfere with operations within sub central bore 24 or within wellbore 12 outside of circulation sub 20.

In order to move valve member 42 from the closed position to the open position, hydraulic pump 50 can pump hydraulic fluid from hydraulic fluid tank 48 into expandable reservoir 54. As hydraulic fluid is pumped into expandable reservoir 54 the hydraulic fluid will act on valve member 42 and when the force of the hydraulic fluid is sufficient to overcome the force of biasing member 44 as well as other resisting forces, then valve member 42 will move to the open position.

When valve member 42 is in the open position of FIG. 3, opening 56 through valve member 42 is aligned with circulation port 40, providing fluid flow path between sub central bore 24 to an annulus defined between the outer diameter surface of circulation sub body 22 and an inner diameter surface of wellbore 12. During certain operations, when valve member 42 is in the open position wellbore fluids can travel from within sub central bore 24 through valve member 42 and to the annulus defined between the outer diameter surface of circulation sub body 22 and an inner diameter surface of wellbore 12. During certain other operations, when valve member 42 is in the open position wellbore fluids can travel from the annulus defined between the outer diameter surface of circulation sub body 22 and an inner diameter surface of wellbore 12, through valve member 42 and into sub central bore 24.

In order to move valve member 42 to the closed position, hydraulic fluid can be returned to hydraulic fluid tank 48 or can be otherwise vented through hydraulic relief valve 52 so that hydraulic fluid leaves expandable reservoir 54. Biasing member 44 can act on valve member 42 to return valve member 42 to the closed position. Valve member 42 can be moved between the closed position and the open position as described any number of times.

Figure 4:
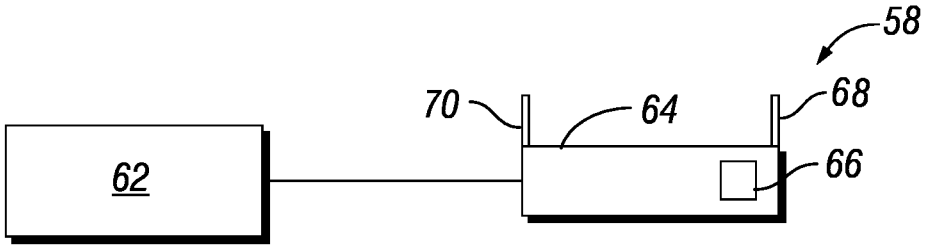
FIG. 4 is a schematic representation of a control system and battery of a smart circulation sub, in accordance with an embodiment of this disclosure.

Control system 58 can be used to instruct actuation assembly 46 to move valve member 42 between the closed position and the open position. Looking at FIG. 4, control system 58 can include an electronic processor 64. Electric processor 64 can have a memory 66, a data transmitter 68, and a data receiver 70.

The electronic processor can to process information gathered from circulation sub 20 and also process information provided from the earth's surface. Electronic processor 64 can provide diagnostic information from circulation sub 20 to an operator at the earth's surface in real time, identifying if a failure has occurred with valve member 42 or circulation port 40.

Control system 58 is located within a sidewall of circulation sub body 22. Control system 58 does not physically interfere with operations within sub central bore 24 or within wellbore 12 outside of circulation sub 20.

Control system 58 can be in wired communication with actuation assembly 46. Control system 58 can communicate with actuation assembly 46 in order to instruct the operation of hydraulic pump 50 and hydraulic relief valve 52. Control system 58 can further be in wired communication with valve member 42. Control system 58 can communicate with valve member 42 to monitor and report the status of valve member 42 in real time.

Control system 58 is in communication with a wireless local area network 60 (FIG. 1) located at the earth's surface by way of radio waves. As an example, the data transmitter and the data receiver of control system 58 can be in communication with local area network 60 by way of radio waves to provide for real time communication between the earth's surface and circulation sub 20. The data transmitter of control system 58 can be used to transmit data from control system 58 to wireless local area network 60. The data receiver of control system 58 can be used to receive information transmitted from the earth's surface to control system 58 by way of local area network 60.

Through communication to an operator at the earth's surface control system 58 can be used to control the operation of circulation sub 20. Control system 58 can also be used to gather the data relating to the status of valve member 42 and deliver such information to the operator at the earth's surface so that the operator can confirm successful operation of circulation sub 20.

Battery 62 can be used to provide power to control system 58 and actuation assembly 46. Battery 62 can be in wired communication with control system 58 and actuation assembly 46. Battery 62 can be, for example, a lithium battery selected to withstand the temperatures of a downhole environment. Battery 62 is located within a sidewall of circulation sub body 22. Battery 62 does not physically interfere with operations within sub central bore 24 or within wellbore 12 outside of circulation sub 20.

In an example of operation, a method for circulating fluids within subterranean well 10 using circulation sub 20 includes securing circulation sub body 22 or circulation sub 20 between downhole drill string 34 and uphole drill string 30. Downhole drill string 34, circulation sub body 22, and uphole drill string 30 are delivered into wellbore 12 of subterranean well 10. When circulation sub 20 reaches a depth of interest where an operation that requires the circulation of fluids through circulation port 40 then control system 58 can instruct actuation assembly 46 to move valve member 42 from the closed position to the open position. In the open position valve member 42 provides a fluid flow path through circulation port 40 from sub central bore 24 to an annulus defined between the outer diameter surface of circulation sub body 22 and an inner diameter surface of wellbore 12.

When using control system 58, an operating command can be transmitted wirelessly from the earth's surface into wellbore 12 to be received by the data receiver that is part of control system 58. The processor that is part of control system 58 can analyze the information received from the earth's surface and send an appropriate command to actuation assembly 46, which in turn will generate the energy required to operate circulation sub 20 independent from any other systems within wellbore 12, such as other tools and subs that are part of tubular string 14.

Actuation assembly 46 can signal hydraulic pump 50 to transfer hydraulic fluid from hydraulic fluid tank 48 into expandable reservoir 54, which acts on valve member 42 so that valve member 42 acts as a piston and moves to the open position, compressing biasing member 44.

The processor of control system 58 can then send a confirmation message to an operator at the earth's surface through the data transmitter that valve member 42 is in the open position and port 40 is open. If there is a failure that leads to valve member 42 not moving to the open position, then the processor of control system 58 can alternately send a message to an operator at the earth's surface that valve member 42 did not reach the open position, that port 40 is not fully open, and that circulation sub 20 has malfunctioned. The data transmitter of control system 58 can be used to transmit the information to the operator at the earth's surface.

When it is desired to close port 40, an operating command can be sent wirelessly to the data receiver of control system 58 from the earth's surface. The processor that is part of control system 58 can analyze the information received from the earth's surface and send an appropriate command to actuation assembly 46, which can be independent from any other systems within wellbore 12, such as other tools and subs that are part of tubular string 14.

Actuation assembly 46 can deactivate hydraulic pump 50 and all hydraulic fluid to drain from expandable reservoir 54 so that biasing member 44 can act on valve member 42 so that valve member 42 moves to the closed position. Hydraulic fluid can be vented out into wellbore 12 through hydraulic relief valve 52.

The processor of control system 58 can then send a confirmation message to an operator at the earth's surface through the data transmitter that valve member 42 is in the closed position and that port 40 is closed. If there is a failure that leads to valve member 42 not moving to the closed position, then the processor of control system 58 can alternately send a message to an operator at the earth's surface that valve member 42 did not reach the closed position, that port 40 is not fully closed, and that circulation sub 20 has malfunctioned. The data transmitter of control system 58 can be used to transmit the information to the operator at the earth's surface.

Embodiments described in this disclosure therefore provide systems and methods for assisting operators at the earth's surface in operating the circulation sub in real time using a wireless communication system. Real time feedback regarding the performance of the circulation sub can be obtained. The ports of the circulation sub can be opened and closed an unlimited number of times. Multiple circulations subs and other tools and subs can be used in the drill string and the communication system can communicate with and operate each of such subs and tools separately and independently due to the scope of possible information that can be exchanged with a wireless radio wave communication system.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A circulation sub for circulating fluids in a subterranean well, the circulation sub including:

a circulation sub body, the circulation sub body being a generally tubular shaped member with a sub central bore, the circulation sub connected to a drillstring located within the well;

a circulation port extending through a sidewall of the circulation sub body;

a valve member moveable between a closed position where the valve member prevents a flow of fluid through the circulation port and an open position where the valve member provides a fluid flow path through the circulation port;

a downhole actuation assembly, the downhole actuation assembly including an isolated hydraulic fluid system operable to move the valve member between the closed position and the open position, where the hydraulic fluid system includes a hydraulic fluid tank and a hydraulic pump, the hydraulic fluid tank containing only hydraulic fluid that is unmixed with another fluid from within the subterranean well, and the hydraulic pump is operable to pump the hydraulic fluid into an expandable reservoir for moving the valve member between the closed position and the open position;

a control system, the control system including an electronic processor, a memory, a data transmitter, and a data receiver; where the control system is operable to instruct the downhole actuation assembly to move the valve member between the closed position and the open position.

2. The assembly of claim 1, further including a biasing member, the biasing member urging the valve member towards the closed position.

3. The assembly of claim 1, further including a battery in wired communication with the control system and the downhole actuation assembly.

4. The assembly of claim 1, where the control system is in wired communication with the downhole actuation assembly.

5. The assembly of claim 1, where the control system is in wired communication with the valve member.

6. The assembly of claim 1, where the data transmitter and the data receiver of the control system is in communication with a local area network located at an earth's surface by way of radio waves.

7. The assembly of claim 1, where the valve member, the downhole actuation assembly, and the control system are located within the sidewall of the circulation sub body.

8. The assembly of claim 1, where the sub central bore has a constant inner diameter from an uphole end of the circulation sub body to a downhole end of the circulation sub body.

9. A circulation sub assembly for circulating fluids in a subterranean well, the assembly including:

a downhole drill string located within a wellbore of the subterranean well and having a downhole central bore;

an uphole drill string located within the wellbore of the subterranean well and having an uphole central bore;

a circulation sub body secured between the downhole drill string and the uphole drill string, the circulation sub body being a generally tubular shaped member with a sub central bore that is in fluid communication with the downhole central bore and the uphole central bore, where the sub central bore has a constant inner diameter from an uphole end of the circulation sub body to a downhole end of the circulation sub body, and where an inner diameter of the sub central bore is substantially equal to an inner diameter of the downhole central bore and an inner diameter of the uphole central bore;

a circulation port extending through a sidewall of the circulation sub body;

a valve member moveable between a closed position where the valve member prevents a flow of fluid through the circulation port, and an open position where the valve member provides a fluid flow path through the circulation port from the sub central bore to an annulus defined between an outer diameter surface of the circulation sub body and an inner diameter surface of the wellbore;

a downhole actuation assembly, the downhole actuation assembly including an isolated hydraulic fluid system operable to move the valve member between the closed position and the open position, where the hydraulic fluid system includes a hydraulic fluid tank and a hydraulic pump, the hydraulic fluid tank containing only hydraulic fluid that is unmixed with another fluid from within the subterranean well, and the hydraulic pump is operable to pump the hydraulic fluid into an expandable reservoir for moving the valve member between the closed position and the open position; and a control system operable to instruct the downhole actuation assembly to move the valve member between the closed position and the open position, where the control system is in communication with a local area network located at an earth's surface by way of radio waves and is in wired communication with the downhole actuation assembly.

10. The assembly of claim 9, further including a biasing member, the biasing member urging the valve member towards the closed position.

11. The assembly of claim 9, further including a battery in wired communication with the control system and the downhole actuation assembly.

12. The assembly of claim 9, where the control system includes an electronic processor, a memory, a data transmitter, and a data receiver.

13. The assembly of claim 9, where the valve member, the downhole actuation assembly, and the control system are located within the sidewall of the circulation sub body.

14. A method for circulating fluids within a subterranean well with a circulation sub, the method including:

securing a circulation sub body between a downhole drill string having a downhole central bore and an uphole drill string having an uphole central bore, where the circulation sub body is a generally tubular shaped member with a sub central bore that is in fluid communication with the downhole central bore and the uphole central bore, where the sub central bore has a constant inner diameter from an uphole end of the circulation sub body to a downhole end of the circulation sub body, where an inner diameter of the sub central bore is substantially equal to an inner diameter of the downhole central bore and an inner diameter of the uphole central bore, and where a circulation port extends through a sidewall of the circulation sub body;

locating the downhole drill string, the circulation sub body, and the uphole drill string within a wellbore of the subterranean well;

using a control system to instruct the downhole actuation assembly to move a valve member between a closed position and an open position, where in the closed position the valve member prevents a flow of fluid through the circulation port, and in the open position the valve member provides a fluid flow path through the circulation port from the sub central bore to an annulus defined between an outer diameter surface of the circulation sub body and an inner diameter surface of the wellbore;

the downhole actuation assembly includes an isolated hydraulic fluid system operable to move the valve member between the closed position and the open position, where the hydraulic fluid system includes a hydraulic fluid tank and a hydraulic pump, the hydraulic fluid tank containing only hydraulic fluid that is unmixed with another fluid from within the subterranean well, and the hydraulic pump pumps the hydraulic fluid into an expandable reservoir, moving the valve member between the closed position and the open position; and the control system is in communication with a local area network located at an earth's surface by way of radio waves and is in wired communication with the downhole actuation assembly.

15. The method of claim 14, further including urging the valve member towards the closed position with a biasing member.

16. The method of claim 14, further including providing power to the control system and the downhole actuation assembly with a battery that is in wired communication with the control system and the downhole actuation assembly.

17. The method of claim 14, where the control system includes an electronic processor, a memory, a data transmitter, and a data receiver.

18. The method of claim 14, where the valve member, the downhole actuation assembly, and the control system are located within the sidewall of the circulation sub body.

19. The method of claim 14, further including delivering a real time status of the valve member to the earth's surface with the control system.

20. The method of claim 14, further including delivering an operating command wirelessly in real time from the earth's surface to the control system.

* * * * *